US011569027B2

(12) United States Patent
Hirama et al.

(10) Patent No.: US 11,569,027 B2
(45) Date of Patent: Jan. 31, 2023

(54) SURFACE-MOUNTED INDUCTOR AND METHOD OF MANUFACTURING THE SAME

(71) Applicant: Murata Manufacturing Co., Ltd., Kyoto-fu (JP)

(72) Inventors: Yoshiaki Hirama, Nagaokakyo (JP); Daigo Mizumura, Nagaokakyo (JP); Ryota Watanabe, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 978 days.

(21) Appl. No.: 16/370,701

(22) Filed: Mar. 29, 2019

(65) Prior Publication Data

US 2019/0304669 A1 Oct. 3, 2019

(30) Foreign Application Priority Data

Apr. 3, 2018 (JP) ..... JP2018-071740

(51) Int. Cl.
*H01F 27/28* (2006.01)
*H01F 27/32* (2006.01)
(Continued)

(52) U.S. Cl.
CPC ..... *H01F 27/327* (2013.01); *H01F 27/2823* (2013.01); *H01F 27/292* (2013.01); *H01F 41/061* (2016.01); *H01F 41/127* (2013.01)

(58) Field of Classification Search
USPC ..... 336/192, 200, 232, 198
See application file for complete search history.

(56) References Cited

U.S. PATENT DOCUMENTS

2004/0046626 A1* 3/2004 Nakata ..... H01F 3/10 336/83
2012/0313740 A1* 12/2012 Inaba ..... H01F 37/00 29/606
(Continued)

FOREIGN PATENT DOCUMENTS

CN 102782783 A 11/2012
CN 103339695 A 10/2013
(Continued)

OTHER PUBLICATIONS

An Office Action; "Notification of Reasons for Refusal," mailed by the Japanese Patent Office dated Jun. 30, 2020, which corresponds to Japanese Patent Application No. 2018-071740 and is related to U.S. Appl. No. 16/370,701 with English language translation.

*Primary Examiner* — Shawki S Ismail
*Assistant Examiner* — Kazi S Hossain
(74) *Attorney, Agent, or Firm* — Studebaker & Brackett PC

(57) ABSTRACT

A surface-mounted inductor including a coil having a wound part formed by winding a conductive wire and extended parts extended from an outer circumference of the wound part, a molded body containing the coil, constituted by a composite material containing a magnetic powder, and outer terminals connected to end portions of the extended parts disposed on a mounting surface. The wound part is contained within the molded body so that a winding axis is parallel to the mounting surface. The extended parts are extended toward the mounting surface side, each end portion of the extended parts are exposed from the surface thereof of the molded body. In the molded body, a density of a magnetic powder between the end portions of the extended parts on the mounting-side surface is lower than a density in the surface on the opposite side from the mounting surface.

4 Claims, 8 Drawing Sheets

(51) Int. Cl.

| | |
|---|---|
| ***H01F 41/12*** | (2006.01) |
| ***H01F 41/061*** | (2016.01) |
| ***H01F 27/29*** | (2006.01) |

(56) References Cited

U.S. PATENT DOCUMENTS

| | | | | |
|---|---|---|---|---|
| 2013/0307655 | A1* | 11/2013 | Saito | H01F 27/292<br>336/83 |
| 2014/0062640 | A1* | 3/2014 | Sasamori | H01F 17/04<br>336/175 |

FOREIGN PATENT DOCUMENTS

| | | | |
|---|---|---|---|
| JP | 2009-267350 | A | 11/2009 |
| JP | 2010-147272 | A | 7/2010 |
| JP | 2012-160507 | A | 8/2012 |
| JP | 2013-211331 | A | 10/2013 |
| JP | 2015-126202 | A | 7/2015 |

* cited by examiner

SURFACE-MOUNTED INDUCTOR AND METHOD OF MANUFACTURING THE SAME

CROSS-REFERENCE TO RELATED APPLICATION

This application claims benefit of priority to Japanese Patent Application No. 2018-071740, filed Apr. 3, 2018, the entire content of which is incorporated herein by reference.

BACKGROUND

Technical Field

The present disclosure relates to a surface-mounted inductor and a method of manufacturing the same.

Background Art

Surface-mounted inductors in which a coil is sealed with a composite material made by kneading together a magnetic powder and a resin are in wide use. For example, Japanese Unexamined Patent Application Publication No. 2010-147272 and Japanese Unexamined Patent Application Publication No. 2009-267350 propose methods of manufacturing a surface-mounted inductor in which an air core coil is positioned using a positioning pin and a support pin provided protruding upward from a base part of a cavity in a metal mold.

In past surface-mounted inductors, the coil is disposed within the molded body with the winding axis of the coil perpendicular to the mounting surface. As such, the end portion of an extended part of the coil is exposed from a side surface of the molded body, and outer terminals are formed on the side surface of the molded body and the mounting surface. In this case, excess resistance is produced by the conduction path spanning from the area of the outer terminal connected to the end portion of the extended part of the coil, to the mounting surface. It has therefore been difficult to achieve lower resistance for handling higher currents. On the other hand, the extended part of the coil must be subjected to difficult processing to expose the end portion of the extended part of the coil on the mounting surface of the molded body, which has caused problems in terms of manufacturing quality.

SUMMARY

Accordingly, embodiments of the present disclosure provide a surface-mounted inductor capable of achieving lower resistance and having excellent insulation breakdown voltage between outer terminals, as well as a method of manufacturing the same.

A surface-mounted inductor according to preferred embodiments of the present disclosure includes a coil including a wound part formed by winding a conductive wire, and extended parts extended from an outer circumference of the wound part; a molded body, constituted by a composite material containing a magnetic powder, that contains the coil; and outer terminals that are connected to corresponding end portions of the extended parts and are disposed on a mounting surface. The wound part of the coil is contained within the molded body so that a winding axis of the wound part is parallel to the mounting surface. The extended parts of the coil are extended toward the mounting surface from the outer circumference of the wound part, and the end portions of the extended parts are disposed so that surfaces thereof are exposed from a mounting surface-side surface of the molded body. In the molded body, a density of the magnetic powder between the end portions of the extended parts on the mounting surface-side surface is lower than a density of the magnetic powder in the surface on the opposite side from the mounting surface.

A method of manufacturing a surface-mounted inductor according to preferred embodiments of the present disclosure includes preparing a coil including a wound part formed by winding a conductive wire, and extended parts extended from an outer circumference of the wound part; and preparing a first reserve molded body constituted by a composite material containing a magnetic powder, the first reserve molded body including a bottom part, a winding shaft part that is disposed on the bottom part and is inserted into a space in the wound part of the coil, and a wall part disposed so as to surround the perimeter of the bottom part, with a cutout part being provided in a part of the wall part. The method further includes disposing the coil inside the first reserve molded body so that the winding shaft part is inserted into the wound part of the coil, the wound part of the coil is surrounded by the wall part, and the extended parts of the coil are extended from the cutout part; pressure-molding the first reserve molded body, in which the coil is disposed, within a metal mold to obtain a molded body that contains the wound part of the coil and in which the surfaces of the end portions of the extended part are exposed; and forming outer terminals that can connect to the surfaces of the end portions of the extended parts.

Other features, elements, characteristics and advantages of the present disclosure will become more apparent from the following detailed description of preferred embodiments of the present disclosure with reference to the attached drawings.

DETAILED DESCRIPTION

Figure 1:
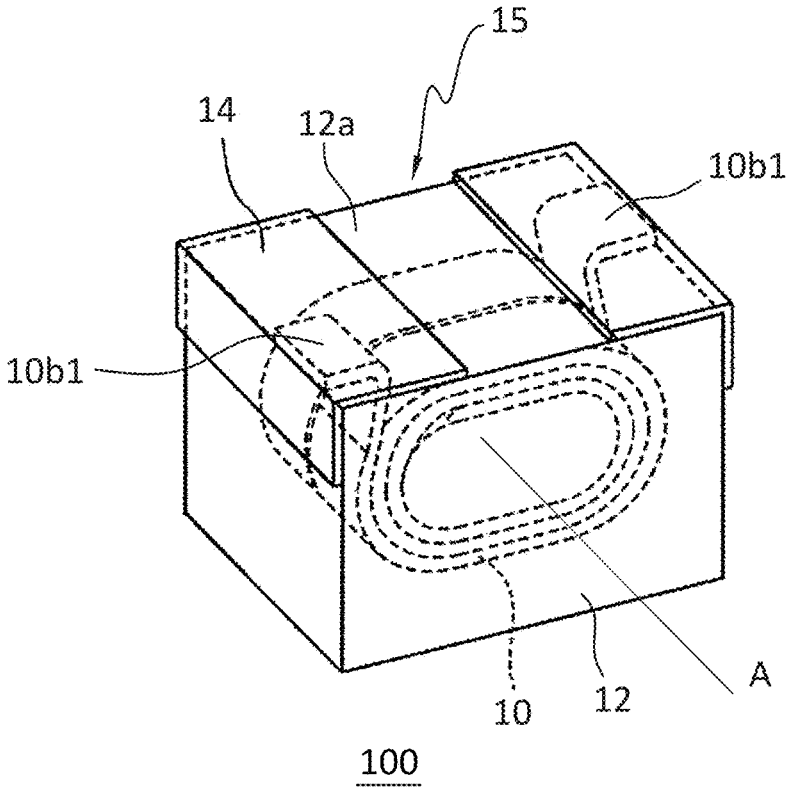
FIG. 1 is a see-through perspective view illustrating an overview of a surface-mounted inductor.

A surface-mounted inductor includes a coil including a wound part formed by winding a conductive wire, and extended parts extended from an outer circumference of the wound part; a molded body, constituted by a composite material containing a magnetic powder, that contains the coil; and outer terminals connected to corresponding end portions of the extended parts and disposed on a mounting surface. The wound part of the coil is contained within the molded body so that a winding axis of the wound part is parallel to the mounting surface. The extended parts of the coil are extended toward the mounting surface from the outer circumference of the wound part, and the end portions of the extended parts are disposed so that surfaces thereof are exposed from a mounting surface-side surface of the molded body. In the molded body, a density of the magnetic powder between the end portions of the extended parts on the mounting surface-side surface is lower than a density of the magnetic powder in the surface on the opposite side from the mounting surface.

When the surfaces of the end portions of the extended parts of the coil are exposed from the mounting surface-side surface of the molded body and connected to the outer terminals, the distance between the end portions of the coil and the parts mounted on a board can be made shorter, which makes it possible to configure a low-resistance surface-mounted inductor. Additionally, the molded body is formed so that the density of the magnetic powder between the end portions of the extended parts on the mounting surface-side surface is lower than the density of the magnetic powder in the surface on the opposite side from the mounting surface, which provides an excellent insulation breakdown voltage between the outer terminals. Furthermore, a small stress is placed on the extended parts of the coil when forming the molded body, which makes it possible to manufacture the inductor with a stable level of quality.

The extended parts of the coil may be disposed so as not to intersect with each other toward the mounting surface side. This makes it possible to further improve the insulation breakdown voltage. Additionally, the distance from the wound part of the coil to the end portions of the extended parts is shortened, which makes it possible to achieve a lower resistance.

The magnetic powder may be a metallic magnetic powder. This makes it possible to achieve even better electrical characteristics. Additionally, the molded body is formed so that the density of the magnetic powder between the end portions of the extended parts on the mounting surface-side surface is lower than the density of the magnetic powder in the surface on the opposite side from the mounting surface, which improves the insulation resistance between the end portions of the coil, and improves the insulation breakdown voltage between the outer terminals.

A method of manufacturing a surface-mounted inductor includes preparing a coil; preparing a first reserve molded body; disposing the first reserve molded body within a metal mold and disposing the coil within the first reserve molded body, or disposing the first reserve molded body, in which the coil is disposed, in the metal mold; pressure-molding the first reserve molded body containing the coil in the metal mold and obtaining a molded body; and forming an outer terminal. The coil that is prepared includes a wound part formed by winding a conductive wire; and extended parts which are extended from outer circumferential parts of the wound part. The first reserve molded body is formed from a composite material containing a magnetic powder. The first reserve molded body includes a bottom part, a winding shaft part that is disposed on the bottom part and is for inserting a winding shaft part into the wound part of the coil, and a wall part disposed so as to surround the perimeter of the bottom part, with a cutout part being provided in a part of the wall part. The coil is disposed inside the first reserve molded body so that the winding shaft part of the first reserve molded body is inserted into the winding axis of the wound part, the wound part is surrounded by the wall part, and the extended parts are extended from the cutout part in the first reserve molded body. The molded body is formed containing the wound part of the coil, with surfaces of the end portions of the extended parts exposed to the exterior of the molded body. At this time, the wound part of the coil is disposed so that the winding axis is parallel to the mounting surface of the molded body, and the surfaces of the end portions of the extended parts of the coil are exposed from the mounting surface-side surface of the molded body. In the molded body, the density of the magnetic powder between the end portions of the extended part on the mounting surface-side surface is lower than the density of the magnetic powder in the surface on the opposite side from the mounting surface. The outer terminals are connected to the surfaces of the end portions of the extended parts, and are formed on the molded body.

By disposing the coil within the first reserve molded body, which has a specific shape, so that the extended parts of the coil are arranged in the cutout part, and forming the molded body through pressure molding, the end portions of the extended parts of the coil can be disposed so as to be exposed from the mounting surface-side surface while reducing the stress on the extended parts of the coil. Additionally, the distance between the end portions of the extended parts of the coil and the mounting surface can be shortened, which makes it possible to reduce the resistance, and furthermore, the insulation breakdown voltage between the outer terminals is improved.

The molded body may be obtained by disposing a second reserve molded body on the first reserve molded body in which the coil is disposed, and pressure-molding the first reserve molded body and the second reserve molded body into a single entity in a metal mold. By using the second reserve molded body, the molded body is formed efficiently, and the quality of manufacture of the molded body can be further stabilized.

The molded body may be obtained by disposing a composite material containing a magnetic powder on the first reserve molded body in which the coil is disposed, and pressure-molding the first reserve molded body and the composite material into a single entity in a metal mold. The process of preparing the second reserve molded body in advance can be omitted, which makes it possible to reduce the number of processes in the method of manufacturing as a whole.

The extended parts of the coil may be oriented and disposed toward the exterior of the first reserve molded body, without intersecting with each other in the cutout part. This makes it possible to further improve the insulation breakdown voltage in the surface-mounted inductor that is manufactured.

Embodiments of the present disclosure will be described hereinafter on the basis of the drawings. Note, however, that the embodiments described hereinafter are merely examples of a surface-mounted inductor embodying the technical spirit of the present disclosure, and the present disclosure is not intended to be limited to the surface-mounted inductors described hereinafter. Additionally, the elements indicated in the scope of patent claims are not limited to the elements of the embodiments in any way. In particular, unless explicitly indicated, the scope of the present disclosure is not intended to be limited to the dimensions, materials, shapes, relative positions, and the like of the constituent elements described in the embodiments, and those factors are merely examples used for descriptive purposes. The sizes, positional relationships, and the like of the elements illustrated in the drawings may be exaggerated to make the descriptions easier to understand. Furthermore, in the following descriptions, like names and reference signs indicate identical or substantially identical elements, and detailed descriptions will be omitted as appropriate. Further still, the elements constituting the present disclosure can be realized by a plurality of elements being constituted by a single member and that single member functioning as the plurality of elements, or conversely, by distributing the functions of a single member among a plurality of members. Additionally, the content described in some embodiments can be used in other embodiments.

EMBODIMENTS

Embodiment 1

Figure 2:
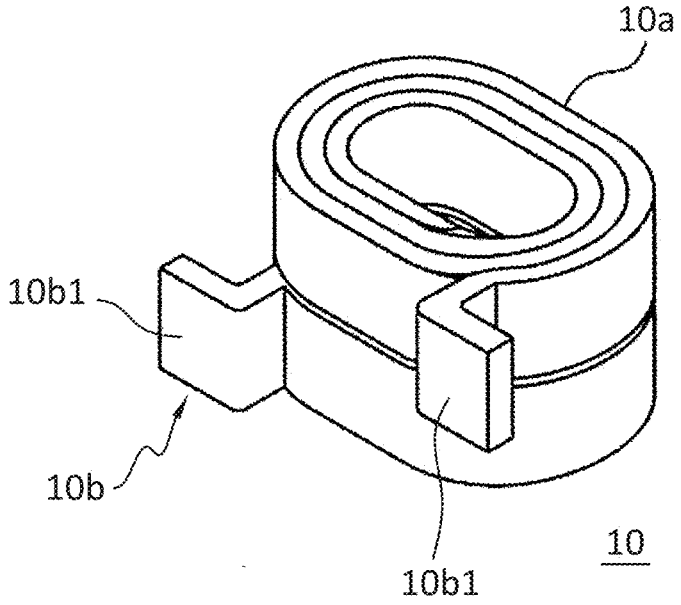
FIG. 2 is a perspective view illustrating an overview of a coil partially constituting the surface-mounted inductor.
Figure 3:
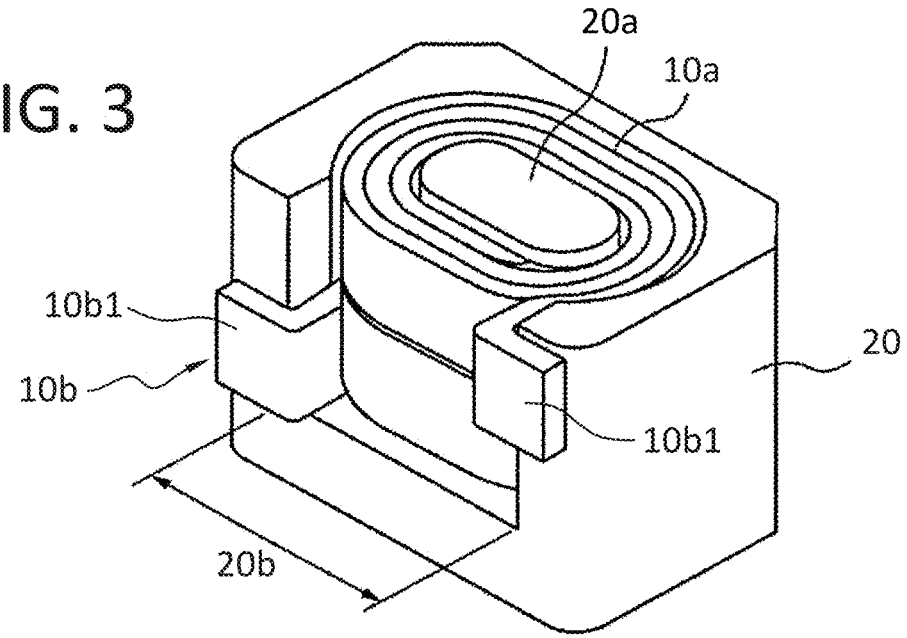
FIG. 3 is a perspective view illustrating an overview of a method of manufacturing the surface-mounted inductor.
Figure 4:
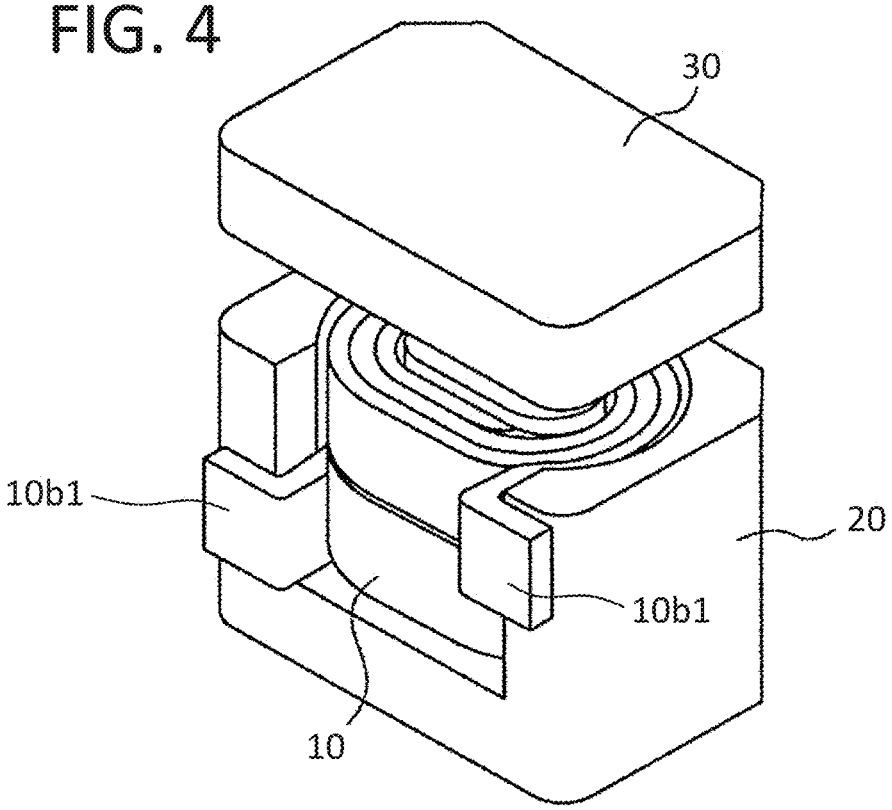
FIG. 4 is a perspective view illustrating an overview of a method of manufacturing the surface-mounted inductor.
Figure 5A:
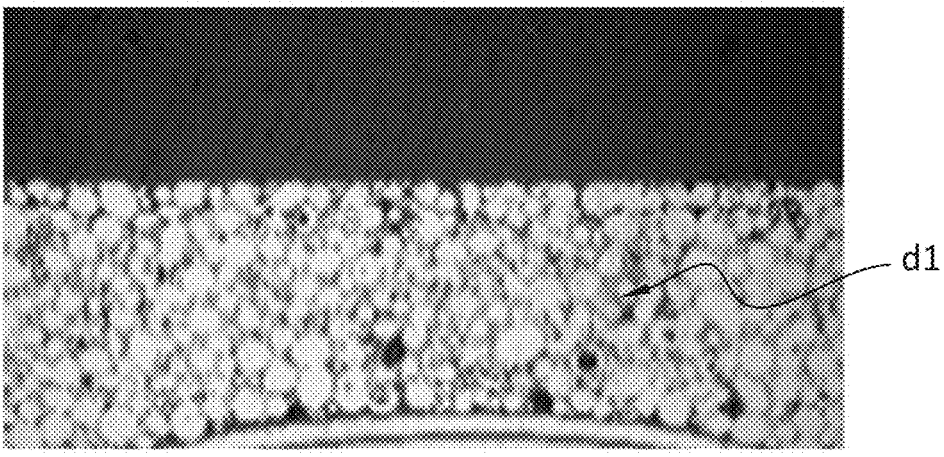
FIG. 5A is a digital microscope image in which an upper surface side of a cross-section of a surface-mounted inductor is partially enlarged.
Figure 5B:
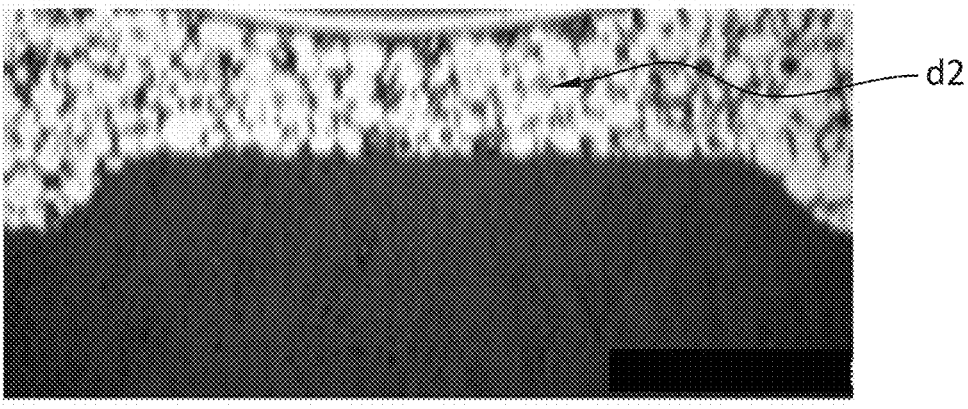
FIG. 5B is a digital microscope image in which a lower surface side of a cross-section of a surface-mounted inductor is partially enlarged.
Figure 6A:
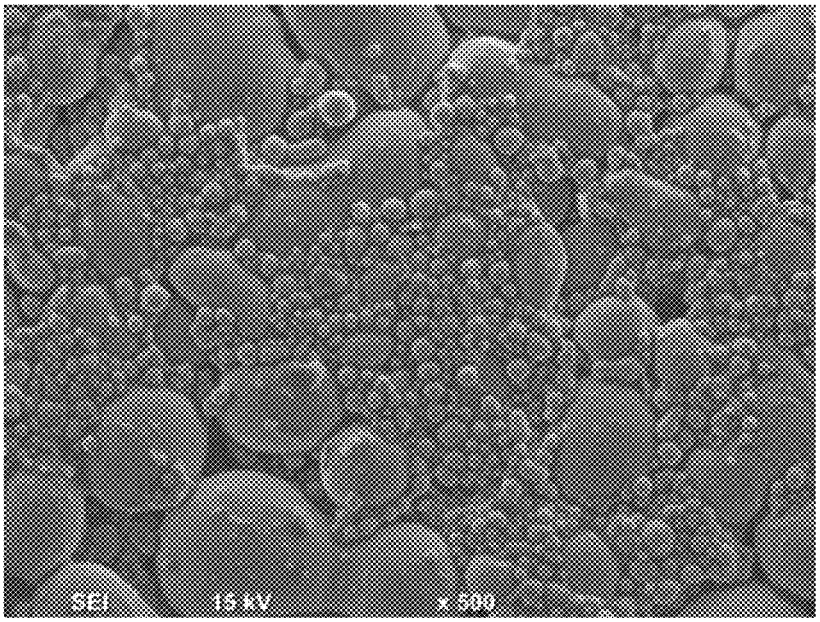
FIG. 6A is a scanning electron microscope (SEM) image of an upper surface part of the surface-mounted inductor.
Figure 6B:
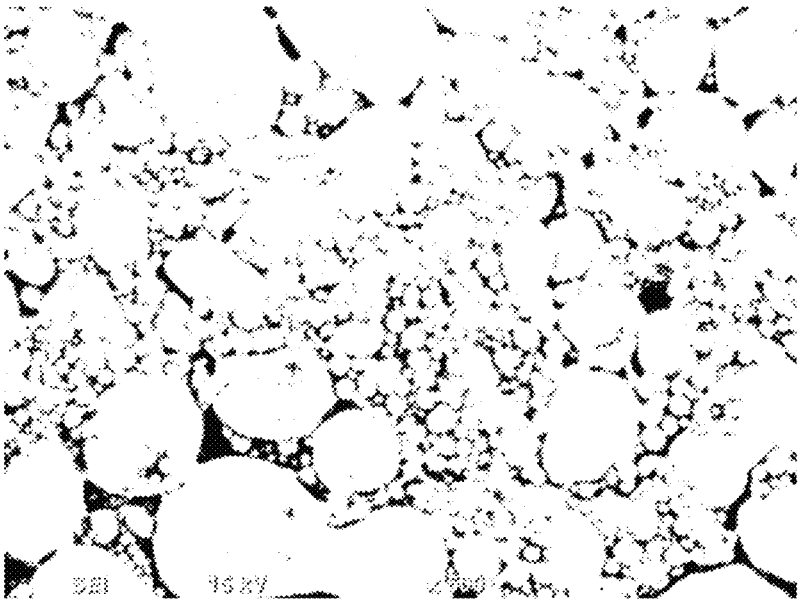
FIG. 6B is an image obtained by subjecting the image in FIG. 6A to a binarizing process.
Figure 7A:
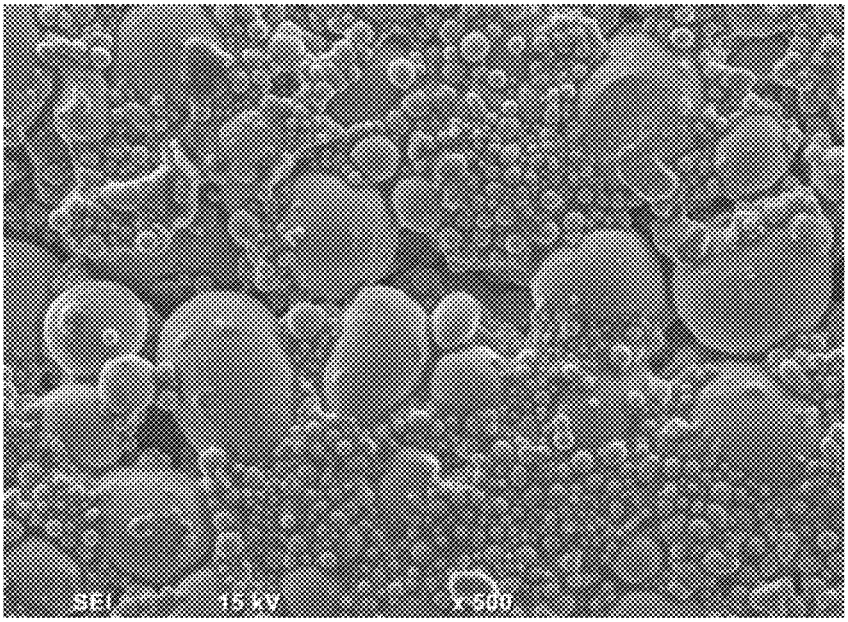
FIG. 7A is a scanning electron microscope (SEM) image of a lower surface part of the surface-mounted inductor.
Figure 7B:
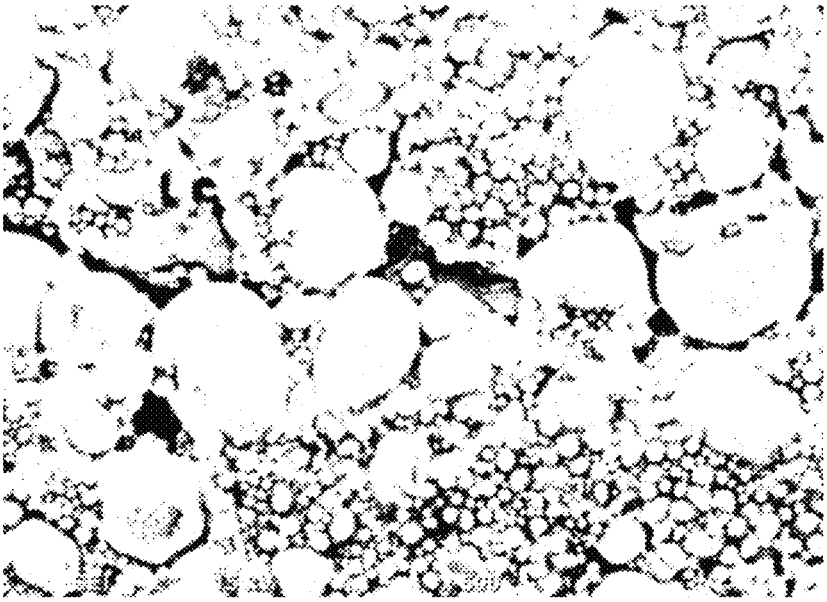
FIG. 7B is an image obtained by subjecting the image in FIG. 7A to a binarizing process.

A surface-mounted inductor 100 according to Embodiment 1 will be described with reference to FIGS. 1 to 4, 5A, 5B, 6A, 6B, 7A, and 7B. FIG. 1 is a see-through perspective view illustrating an overview of an example of the surface-mounted inductor 100. FIG. 2 is a perspective view illustrating an overview of an example of a coil 10 partially constituting the surface-mounted inductor 100. FIGS. 3 and 4 are perspective views illustrating an overview of a method of manufacturing the surface-mounted inductor 100. FIG. 5A is a digital microscope image in which an upper surface side of a cross-section of the surface-mounted inductor 100 is partially enlarged, and FIG. 5B is a digital microscope image in which a lower surface side of the cross-section of the surface-mounted inductor 100 is partially enlarged. FIG. 6A is a scanning electron microscope (SEM) image of an upper surface part of the surface-mounted inductor 100, and FIG. 6B is an image obtained by subjecting the image in FIG. 6A to a binarizing process. FIG. 7A is a scanning electron microscope (SEM) image of a lower surface part of the surface-mounted inductor 100, and FIG. 7B is an image obtained by subjecting the image in FIG. 7A to a binarizing process.

As illustrated in FIG. 1, the surface-mounted inductor 100 includes: a molded body 12 constituted by a composite material containing a magnetic powder; the coil 10, which is contained within the molded body 12; and outer terminals 14, which are connected to corresponding end portions 10*b*1 of extended parts 10*b* of the coil 10, and each of which is arranged spanning from part of a mounting surface to part of a side surface. The molded body 12 has a lower surface 12*a* on a mounting surface side as a mounting surface-side surface, an upper surface opposite the lower surface 12*a*, and four side surfaces adjacent to the lower surface 12*a* and the upper surface. The molded body 12 has a longitudinal direction parallel to the major axis direction in a cross-section orthogonal to the winding axis A of the coil 10, a lateral direction parallel to the winding axis direction of the coil, and a height corresponding to a distance between the lower surface 12*a* and the upper surface. The coil 10 is contained within the molded body 12 so that the winding axis A thereof is parallel to the lower surface 12*a* of the molded body 12, and the winding axis A of the coil 10 is parallel to the mounting surface 15 of the surface-mounted inductor 100. The extended parts 10*b* are extended from the outer circumference of the wound part of the coil 10, toward the mounting surface direction, without intersecting with each other, with the end portions 10*b*1 of the extended parts 10*b* being exposed from the lower surface 12*a* of the molded body 12 and extending along the lower surface 12*a* in the directions of opposite side surfaces of the molded body 12 (i.e., in directions opposite from each other). Surfaces of the end portions 10*b*1 are exposed from the lower surface 12*a* of the molded body 12, and end surfaces of the end portions 10*b*1 are exposed from the side surfaces of the molded body 12. The outer terminals 14 are electrically connected to the end portions 10*b*1 of the extended parts 10*b* exposed from the lower surface 12*a*. The outer terminals 14 connected to the end portions of the coil 10 at the lower surface part of the molded body 12 are formed as substantially L shapes, each spanning both the lower surface 12*a* and a side surface that is adjacent to the lower surface 12*a* and on which the end surface of the end portion is exposed. The height of the outer terminals 14 on the side surfaces of the molded body 12 are greater than or equal to approximately ¼ of the height of the molded body 12, for example. Additionally, in the molded body 12, the density d2 of the magnetic powder at an area of the lower surface 12*a* interposed between the end portions 10*b*1 of the extended parts 10*b* is lower than the density d1 of the magnetic powder at the upper surface (not illustrated).

Because the outer terminals 14 are connected at the end portions 10*b*1 of the extended parts 10*b* of the coil 10 and the lower surface parts of the molded body 12, it is possible to shorten the path of current flowing between the extended parts and the mounting board through the outer terminals when the surface-mounted inductor 100 is mounted on the mounting board at the mounting surface 15. For example, the DC resistance value can be reduced from what has been approximately 6.15 mΩ in the past, to approximately 4.88 mΩ. Additionally, when the height of the outer terminals 14 on the side surfaces of the molded body 12 are greater than or equal to approximately ¼ the height of the side surfaces of the molded body 12, solder fillets can be formed so as to be visible during mounting, which improves the reliability of connections with wiring patterns when mounting the inductor on the mounting board. Additionally, having a lower magnetic powder density on the lower surface side of the molded body 12 provides a better insulation breakdown voltage between the outer terminals.

In addition to the magnetic powder, the composite material of the molded body 12 may contain a binding agent such as a resin. The following are examples of powders that can be used as the magnetic powder: an iron-based metallic magnetic powder, including iron (Fe), Fe—Si, Fe—Si—Cr, Fe—Si—Al, Fe—Ni—Al, Fe—Cr—Al, or the like; a metallic magnetic powder of a composition not containing iron; a metallic magnetic powder of another composition containing iron; an amorphous metallic magnetic powder; a metallic magnetic powder in which the surfaces are covered with insulating bodies such as glass; a metallic magnetic powder in which the surfaces have been modified; an extremely fine (nano level) metallic magnetic powder; a ferrite powder; or the like. Thermoset resins such as epoxy resin, polyimide resin, or phenol resin, or thermoplastic resins such as polyester resin or polyamide resin, can be used as the binding agent. The molded body 12 of the surface-mounted inductor according to Embodiment 1 is constituted by using, for example, an Fe—Si—Cr-based metallic magnetic powder as the magnetic powder and epoxy resin as the binding agent.

The molded body 12 is formed, for example, with a longitudinal direction length L of approximately 2.5 mm, a lateral direction length W of approximately 2.0 mm, and a height T of approximately 2.0 mm, for a size known as "25-20-20".

As illustrated in FIG. 2, the coil 10 is formed including: a wound part 10*a* formed by winding flat wire, which is a conductor having a substantially rectangular cross-section, in two levels; and extended parts 10*b*, which are extended from outer circumferential parts of the wound part 10*a*. The conductor of which the coil 10 is formed includes an insulative coating such as polyester resin (not illustrated). In FIG. 2, the wound part 10*a* is formed so that the cross-section thereof orthogonal to the winding axis A is an ellipse, an oval, or the like having a major axis and a minor axis. The wound part 10*a* is wound and formed in two levels so that both ends of the conductor are positioned on the outer circumference, and the extended parts 10*b* are extended from outer circumferential parts on the upper level and the lower level, respectively. The extended parts 10*b* respectively extend in the same direction, substantially orthogonal to the major axis direction of the wound part 10*a*. The extended parts 10*b* have end portions 10*b*1 that are bent in mutually-opposite directions with respect to the major axis direction and extend parallel to the major axis direction.

The surface-mounted inductor 100 is manufactured by, for example, pressure-molding an intermediate member such as that illustrated in FIG. 3. In FIG. 3, the wound part 10*a* of the coil is disposed within a first reserve molded body 20, and the end portions 10*b*1 of the extended parts 10*b* of the coil are disposed along an outer side surface of the first reserve molded body 20. The first reserve molded body 20 is formed from a composite material containing a magnetic powder, and has a bottom part, a winding shaft part 20*a* arranged on the bottom part, and a wall part arranged so as to surround the bottom part. A cutout part 20*b* is provided in part of one of four side surfaces surrounding the bottom part of the wall part. The winding shaft part 20*a* is formed protruding from the bottom part so as to be capable of inserting into the winding axis of the wound part 10*a* of the coil. The bottom part and the wall part of the first reserve molded body 20 are formed so as to be able to contain the wound part 10*a* of the coil therein. The wall part of the first reserve molded body 20 is formed protruding from the bottom part along the outer perimeter of the bottom part.

The coil 10 is disposed within the first reserve molded body 20 from the side of the first reserve molded body 20 on which the winding shaft part 20*a* is provided, and the winding shaft part 20*a* is inserted into the winding axis of the wound part 10*a* of the coil. The surface of the wound part 10*a* of the coil that is orthogonal to the winding axis A is in contact with the bottom part of the first reserve molded body 20. The surface of the wound part 10*a* of the coil that is parallel to the winding axis A is surrounded by the wall part of the first reserve molded body 20, with the exception of the region interposed between the extended parts 10*b* of the coil. The extended parts 10*b* of the coil are arranged along the wall parts on either side of the cutout part 20*b* in the first reserve molded body 20. The end portions 10*b*1 of the extended parts 10*b* of the coil are exposed to the exterior of the first reserve molded body 20 from the cutout part 20*b*, and are arranged along one of the four side surfaces of the wall part of the first reserve molded body 20. Additionally, the end portions 10*b*1 of the extended parts 10*b* of the coil are held between the first reserve molded body 20 and a metal mold (not illustrated).

One example of a method of manufacturing the surface-mounted inductor includes: preparing a coil formed in a predetermined shape; preparing a first reserve molded body having a predetermined shape; disposing the first reserve molded body within a metal mold and disposing the coil within the first reserve molded body, or disposing the first reserve molded body, in which the coil is disposed, in the metal mold; pressure-molding the first reserve molded body containing the coil in the metal mold and obtaining a molded body in which a surface of an end portion of the coil is exposed on a mounting surface side; and forming an outer terminal that can connect to a surface of the exposed end portion of the coil.

Specifically, the first reserve molded body 20, which contains the coil as illustrated in FIG. 3, is pressure-molded in the metal mold, in the winding axis direction, in a heated state. As a result, the side of the first reserve molded body 20 opposite from the bottom part (the upper side of the coil) and the cutout part 20*b* are covered by the composite material, and a molded body is formed with the end portions 10*b*1 of the extended parts 10*b* of the coil exposed on the surface and the wound part of the coil contained in the interior. In FIG. 4, a second reserve molded body 30 is disposed on the side of the first reserve molded body 20, which contains the coil 10, opposite from the bottom part. The first reserve molded body 20 and the second reserve molded body 30 are arranged in the metal mold and, in a heated state, are pressure-molded in a direction parallel to the winding axis A of the wound part of the coil using the metal mold. An integrated molded body is formed as a result. The second reserve molded body 30 is formed from a composite material containing a magnetic powder in the same manner as the first reserve molded body 20. In FIG. 4, the second reserve molded body 30 is formed as a substantially flat plate, and is shaped to cover the side of the first reserve molded body 20 opposite from the bottom part. When the second reserve molded body 30 is disposed on the side of the first reserve molded body 20 opposite from the bottom part and pressure-molded, the side of the first reserve molded body 20 opposite from the bottom part is covered by the pressure-molded entity corresponding to the second reserve molded body 30. Additionally, the cutout part 20*b* is covered by part of the composite material constituting the first reserve molded body 20 and the second reserve molded body 30 wrapping around the side surfaces of the wound part 10*a* of the coil. A difference therefore arises in the fluidity of the composite material, between the area near the cutout part 20*b* and the other areas formed by the first or second reserve molded body, during the pressure molding. As a result, the density of the magnetic powder near the cutout part 20*b*, in the side surface where the cutout part 20*b* is provided and that will serve as the lower surface 12*a* of the molded body, becomes lower than the density of the magnetic powder in other areas, such as the area serving as the upper surface of the molded body. This can be thought of as follows, for example. Near the cutout part 20*b*, magnetic powder particles, which have a greater particle diameter than in the composite material in other parts, wrap around the side surfaces of the wound part 10*a* of the coil. With the magnetic powder contained in the composite material, magnetic powder particles having a smaller particle diameter experience greater friction with other magnetic powder particles, and tend to have difficulty filling in between magnetic powder particles having large particle diameters.

Thus in an area of the molded body corresponding to the cutout part 20*b*, the content of magnetic powder particles having a small particle diameter is lower than in areas of the molded body formed from the first reserve molded body 20, which is thought to effectively reduce the density of the magnetic powder. Using the first reserve molded body and the second reserve molded body having such shapes is suited to forming a molded body having a size less than or equal to "25-20-20", i.e., a longitudinal direction length L of approximately 2.5 mm, a lateral direction length W of approximately 2.0 mm, and a height T of approximately 2.0 mm.

In the molded body 12 of the surface-mounted inductor 100, the density of the magnetic powder in an area corresponding to a second opening, which is the space between the end portions 10*b*1 of the extended parts 10*b* on the mounting surface-side lower surface 12*a*, is lower than the density of the magnetic powder at the upper surface of the molded body. This area of low magnetic powder density is interposed between the end portions 10*b*1 of the extended parts 10*b* of the coil to which the outer terminals are connected, and thus the insulation breakdown voltage between the end portions of the coil is improved even if the magnetic powder is a metallic magnetic powder. Here, the density of the magnetic powder in the molded body 12 is calculated as the ratio of the surface area of magnetic powder particles to a unit of surface area in SEM image observation, which will be described later.

For example, when, as disclosed in Japanese Unexamined Patent Application Publication No. 2013-211331, a coil having intersecting extended parts is contained within a reserve molded body having a cutout for extending the extended parts of the coil, and the pressure-molding is carried out from the cutout side in the reserve molded body, the composite material will be compressed by the mold and the extended parts of the coil, which makes it easy for even magnetic powder particles having small particle diameters, contained within the composite material, to flow. It is thus thought that no difference will arise in the magnetic powder density between the area on the mounting surface side and other areas. Even when, for example, a reserve molded body in which the small area of the cutout for extending the end portions of the coil is used, as disclosed in Japanese Unexamined Patent Application Publication No. 2012-160507, it is thought that no difference will arise in the magnetic powder density between the area on the mounting surface side and other areas.

FIG. 5A is a digital microscope (manufactured by Keyence Corporation) image in which a part near the center of the upper surface of the molded body, in a cross-section orthogonal to the winding axis direction of the coil of the surface-mounted inductor 100, is partially enlarged. FIG. 5B, meanwhile, is a digital microscope (manufactured by Keyence Corporation) image in which a part near the center of the lower surface 12*a* of the molded body, in a cross-section orthogonal to the winding axis direction of the coil of the surface-mounted inductor 100, is partially enlarged. As indicated in FIG. 5A, on the upper surface of the surface-mounted inductor 100, magnetic powder particles having small particle diameters are densely packed into the gaps between magnetic powder particles having large particle diameters. However, as indicated in FIG. 5B, on the lower surface side of the surface-mounted inductor 100, fewer magnetic powder particles having small particle diameters are present in the gaps between the magnetic powder particles having large particle diameters than on the upper surface side. In other words, the density d2 of the magnetic powder in the area interposed between the extended parts on the lower surface side of the molded body is lower than the density d1 of the magnetic powder in the upper surface-side areas.

An example of a method of measuring the density of the magnetic powder in the molded body will be described next using FIGS. 6A, 6B, 7A, and 7B. FIG. 6A is an example of an SEM image (approximately 500×) of an upper surface part of the molded body, and FIG. 6B is an image obtained by using image processing software to binarize the image in FIG. 6A. FIG. 7A is an example of an SEM image (approximately 500×) of a lower surface part of the molded body, and FIG. 7B is an image obtained by using image processing software to binarize the image in FIG. 7A.

The SEM image in FIG. 6A is obtained by observing the surface of an upper surface part of the molded body at approximately 500×. In the binarized image in FIG. 6B, the white parts correspond to areas where the magnetic powder is present. Thus by calculating the ratio of the area of white parts to the area of the observation area as a whole, the density of the magnetic powder in the observation area of the SEM image can be estimated. Calculating the density of the magnetic powder in the upper surface part of the molded body from FIG. 6B results in a density of approximately 90.2%.

The SEM image in FIG. 7A is obtained by observing the surface of a lower surface part of the molded body at approximately 500×. In the binarized image in FIG. 7B, the white parts correspond to areas where the magnetic powder is present. Calculating the density of the magnetic powder in the lower surface part of the molded body from FIG. 7B in the same manner as in FIG. 6B results in a density of approximately 83.4%. Thus the magnetic powder density ratio of the lower surface 12*a* to the upper surface of the molded body is approximately 0.92. In the surface-mounted inductor 100, the ratio of the magnetic powder density of the lower surface 12*a* to the upper surface of the molded body is, for example, greater than or equal to approximately 0.8 and less than or equal to approximately 0.99 (i.e., from approximately 0.8 to approximately 0.99), and preferably is greater than or equal to approximately 0.85 and less than or equal to approximately 0.97 (i.e., from approximately 0.85 to approximately 0.97). Note that GIMP (by Spencer Kimball, Peter Mattis, and the GIMP Development Team) can be used as the image processing software.

Although in the surface-mounted inductor 100, the coil 10 is formed by winding a conductive wire having a substantially rectangular cross-section, the cross-sectional shape of the conductive wire may be a shape aside from a rectangle, such as a circle, a polygon, or the like. Also, although the wound part of the coil has a substantially elliptical shape when viewed from the axial direction, the wound part may have a shape aside from an ellipse, such as a circle, an oval, a rectangle, or a polygon. Additionally, the outer terminals may be arranged only on the lower surface 12*a* of the molded body, or may be formed spanning three side surfaces adjacent to the lower surface 12*a*. Furthermore, the end surfaces of the end portions 10*b*1 of the extended parts 10*b* of the coil may be formed so as not to be exposed from the side surfaces of the molded body.

Embodiment 2

A surface-mounted inductor according to Embodiment 2 has the same configuration as the surface-mounted inductor according to Embodiment 1, aside from the magnetic powder of the molded body containing a first magnetic powder having a first average particle diameter D50 and a second magnetic powder having a second average particle diameter D50 that is smaller than the first average particle diameter D50. Here, the average particle diameter D50 is found as a particle diameter corresponding to a volume accumulation of approximately 50% in a grain size distribution of the magnetic powder, measured by a laser diffraction-type grain size distribution measurement apparatus.

The first average particle diameter D50 is approximately 30 μm, for example, and the second average particle diameter D50 is approximately 5 μm, for example. Additionally, the mixture ratio of the first magnetic powder to the second magnetic powder is, for example, approximately 7:3 by weight. The composite material constituting the molded body contains a resin in addition to the magnetic powder. The resin is, for example, greater than or equal to approximately 2.5 wt % and less than or equal to approximately 4 wt % (i.e., from approximately 2.5 wt % to approximately 4 wt %) relative to the total weight of the magnetic powder. When the surface-mounted inductor is manufactured using the composite material having this composition, through the same method of manufacturing as that described in Embodiment 1, the density of the magnetic powder in an area, on the lower surface side of the molded body, that is interposed between the extended parts, has a lower density than the magnetic powder in an area on the upper surface side.

Although the particle diameter ratio of the first average particle diameter D50 to the second average particle diameter D50 is approximately 6 in the surface-mounted inductor according to Embodiment 2, the particle diameter ratio may be, for example, greater than or equal to approximately 2 and less than or equal to approximately 20 (i.e., from approximately 2 to approximately 20), and is preferably greater than or equal to approximately 3 and less than or equal to approximately 15 (i.e., from approximately 3 to approximately 15). Additionally, although the mixture ratio between the first magnetic powder and the second magnetic powder is approximately 2.33, the mixture ratio of the first magnetic powder to the second magnetic powder may be, for example, greater than or equal to approximately 1.5 and less than or equal to approximately 6 (i.e., from approximately 1.5 to approximately 6), and is preferably greater than or equal to approximately 2 and less than or equal to approximately 4 (i.e., from approximately 2 to approximately 4).

Embodiment 3

A surface-mounted inductor according to Embodiment 3 has the same configuration as the surface-mounted inductor according to Embodiment 1, aside from the following points: the coil is formed so as to include the wound part 10*a*, formed by winding flat wire, which is a conductor having a substantially rectangular cross-section, in two levels, and the extended parts 10*b*, which are extended from outer circumferential parts of the wound part 10*a*; and the extended parts extended from the outer circumferential parts of the wound part of the coil are caused to extend in opposite directions so as to intersect with each other, with the extended parts of the coil being extended toward the mounting surface of the molded body, and the end portions 10*b*1 of the extended parts 10*b* being exposed on the lower surface of the molded body.

In the surface-mounted inductor according to Embodiment 3, the extended parts are extended toward the mounting surface from the outer circumferential parts of the wound part so as to intersect with each other, and the surfaces of the end portions 10*b*1 of the extended parts 10*b* are exposed on the lower surface of the molded body. Additionally, the molded body is formed as follows. A first reserve molded body is prepared, the first reserve molded body including a bottom part, a winding shaft part disposed on the bottom part for insertion into the winding axis of the wound part of the coil, and a wall part arranged surrounding the perimeter of the bottom part, with a cutout part being provided in a part of one of the four side surfaces of the wall part. The coil is attached to the first reserve molded body with the extended parts extending in opposite directions so as to intersect with each other, and the end portions 10*b*1 of the extended parts 10*b* of the coil are extended from the cutout part and extended along one of the four side surfaces of the wall part. A second reserve molded body is arranged on the side opposite from the side on which the bottom part of the first reserve molded body is located, and these elements are then pressure-molded using a metal mold in a direction parallel to the winding axis of the wound part of the coil. Accordingly, the density of the magnetic powder in an area of the lower surface of the molded body interposed between the end portions 10*b*1 of the extended parts 10*b* of the coil is lower than the density of the magnetic powder in the upper surface.

Because the extended parts are extended to the lower surface of the molded body so as to intersect with each other, a small stress is placed on the conductors when forming the extended parts, which makes it possible to form the parts in a more stable manner. Additionally, making the density of the magnetic powder lower in the area of the lower surface interposed between the end portions 10*b*1 of the extended parts 10*b* of the coil improves the insulation breakdown voltage characteristics.

Embodiment 4

A method of manufacturing a surface-mounted inductor according to Embodiment 4 corresponds to the method of manufacturing the surface-mounted inductor according to Embodiment 3. The method of manufacturing the surface-mounted inductor according to Embodiment 4 is the same as the method of manufacturing according to Embodiment 1, except that the coil arranged within the first reserve molded body is arranged so that the extended parts extended from the outer circumferential parts of the wound part of the coil intersect with each other in a cutout part of the first reserve molded body, and the end portions thereof are extended and arranged outside the first reserve molded body.

In the method of manufacturing according to Embodiment 4, the extended parts are extended to the lower surface of the molded body so as to intersect with each other, and thus a small stress is placed on the conductors when forming the extended parts, which makes it possible to form the parts in a more stable manner. Additionally, making the density of the magnetic powder lower in the area of the lower surface interposed between the end portions 10*b*1 of the extended parts 10*b* of the coil improves the insulation breakdown voltage characteristics.

Embodiment 5

Figure 8:
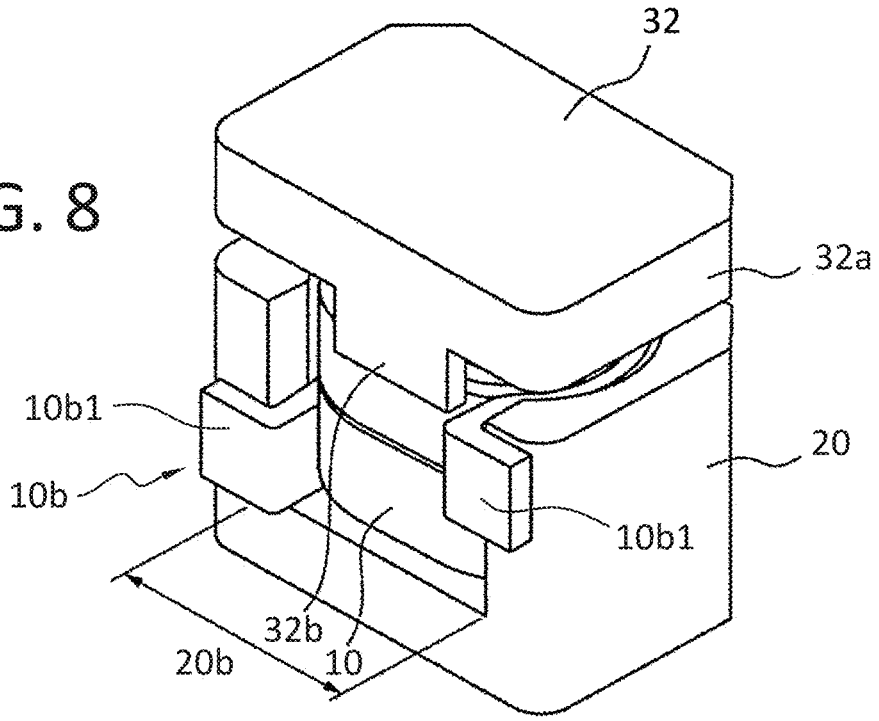
FIG. 8 is a perspective view illustrating an overview of a method of manufacturing a surface-mounted inductor.

A method of manufacturing a surface-mounted inductor according to Embodiment 5 will be described with reference to FIG. 8. FIG. 8 is a perspective view illustrating an overview of a method of manufacturing a surface-mounted inductor. The method of manufacturing the surface-mounted inductor according to Embodiment 5 is the same as the method of manufacturing according to Embodiment 1, aside from a second reserve molded body 32 having a protruding part being used instead of the substantially plate-shaped second reserve molded body 30 used in Embodiment 1.

As illustrated in FIG. 8, the second reserve molded body 32 includes a plate-shaped part 32*a* that covers the bottom part of the first reserve molded body 20 and the side opposite from the side on which the bottom part is located; and a protruding part 32*b* that protrudes from one part of an outer peripheral part of the plate-shaped part 32*a* and is partially inserted into the cutout part 20*b* of the first reserve molded body 20. The protruding part 32*b* is narrower than the cutout part 20*b*, is formed shorter than the height of the cutout part 20*b*, and covers a part of a second opening in the first reserve molded body 20. By forming the first reserve molded body 20, in which the coil 10 is disposed, and the second reserve molded body 32 as a single entity within the metal mold, a molded body containing the wound part of the coil, and in which the surfaces of the end portions 10*b*1 of the extended parts 10*b* of the coil are exposed from the lower surface, is formed.

The second reserve molded body 32 includes the protruding part 32*b*, and thus during the pressure molding, a sufficient amount of the composite material covering the cutout part 20*b* of the first reserve molded body 20 is supplied so as to more reliably cover the cutout part 20*b*. The precision of the positioning when arranging the second reserve molded body is also improved. The protruding part 32*b* of the second reserve molded body 32 is formed so as to be smaller than the cutout part 20*b* of the first reserve molded body 20, the composite material constituting the second reserve molded body 32 flows along the wound part of the coil 10 and covers the cutout part 20*b*. Accordingly, the area of the molded body corresponding to the cutout part 20*b* has a lower magnetic powder density than the other areas directly formed from the first reserve molded body 20 or the second reserve molded body 32.

Embodiment 6

Figure 9:
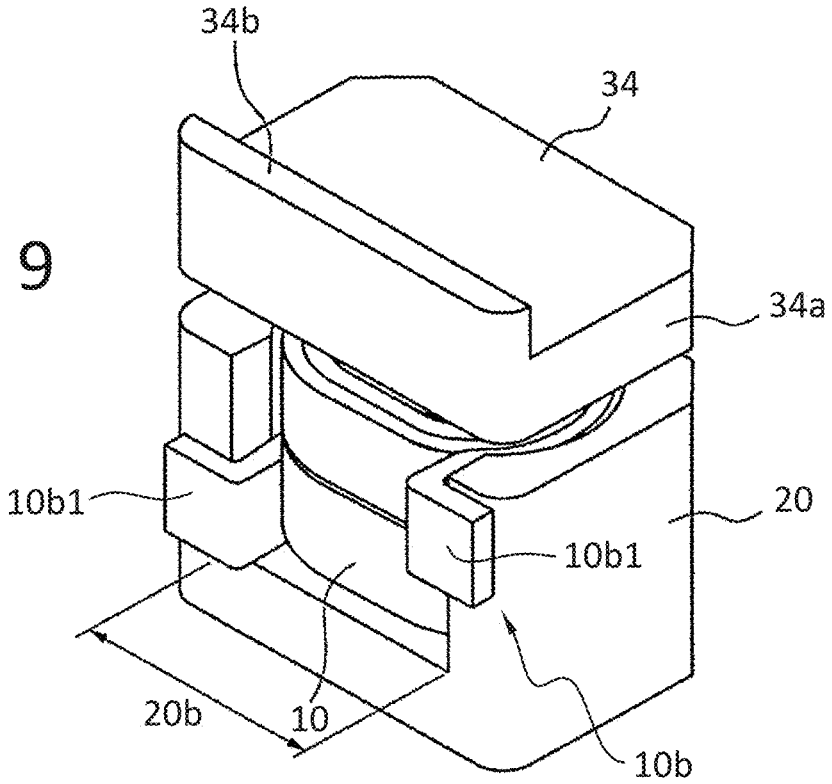
FIG. 9 is a perspective view illustrating an overview of a method of manufacturing a surface-mounted inductor.

A method of manufacturing a surface-mounted inductor according to Embodiment 6 will be described with reference to FIG. 9. FIG. 9 is a perspective view illustrating an overview of a method of manufacturing a surface-mounted inductor. The method of manufacturing the surface-mounted inductor according to Embodiment 6 is the same as the method of manufacturing according to Embodiment 1, aside from a second reserve molded body 34, including a plate-shaped part 34*a* and a protruding part 34*b* protruding from the plate-shaped part, being used.

As illustrated in FIG. 9, the second reserve molded body 34 includes: the plate-shaped part 34*a*, which covers the bottom part of the first reserve molded body 20 and the side opposite from the side on which the bottom part is located; and the protruding part 34*b*, which protrudes from one part of an outer peripheral part of the plate-shaped part 34*a*, in the direction opposite from the side on which the cutout part 20*b* of the first reserve molded body 20 is located. In FIG. 9, the protruding part 34*b* is formed having the same width as the first reserve molded body 20. By forming the first reserve molded body 20, in which the coil 10 is disposed, and the second reserve molded body 34 as a single entity within the metal mold, a molded body containing the wound part of the coil, and in which the surfaces of the end portions 10*b*1 of the extended parts 10*b* are exposed from the lower surface, is formed.

The second reserve molded body 34 includes the protruding part 34*b*, and thus during the pressure molding, a sufficient amount of the composite material covering the cutout part 20*b* is supplied so as to more reliably cover the cutout part 20*b*. The cutout part 20*b* of the first reserve molded body 20 is covered by the composite material supplied from the second reserve molded body 34 flowing along the wound part of the coil 10. Accordingly, the area of the molded body corresponding to the cutout part 20*b* has a lower magnetic powder density than the other areas directly formed from the first reserve molded body 20 or the second reserve molded body 34.

Figure 10:
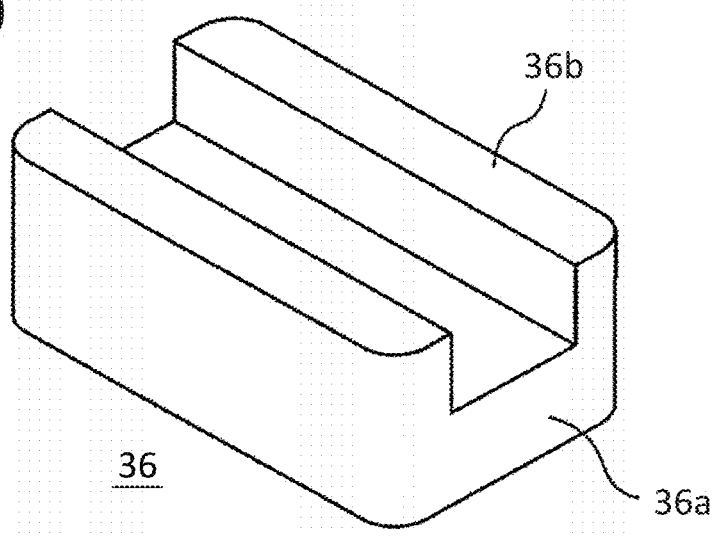
FIG. 10 is a perspective view illustrating an overview of a variation on a second reserve molded body.
Figure 11:
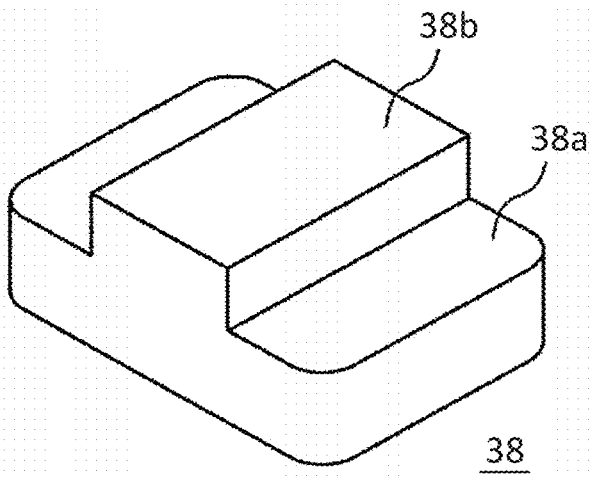
FIG. 11 is a perspective view illustrating an overview of a variation on a second reserve molded body.
Figure 12:
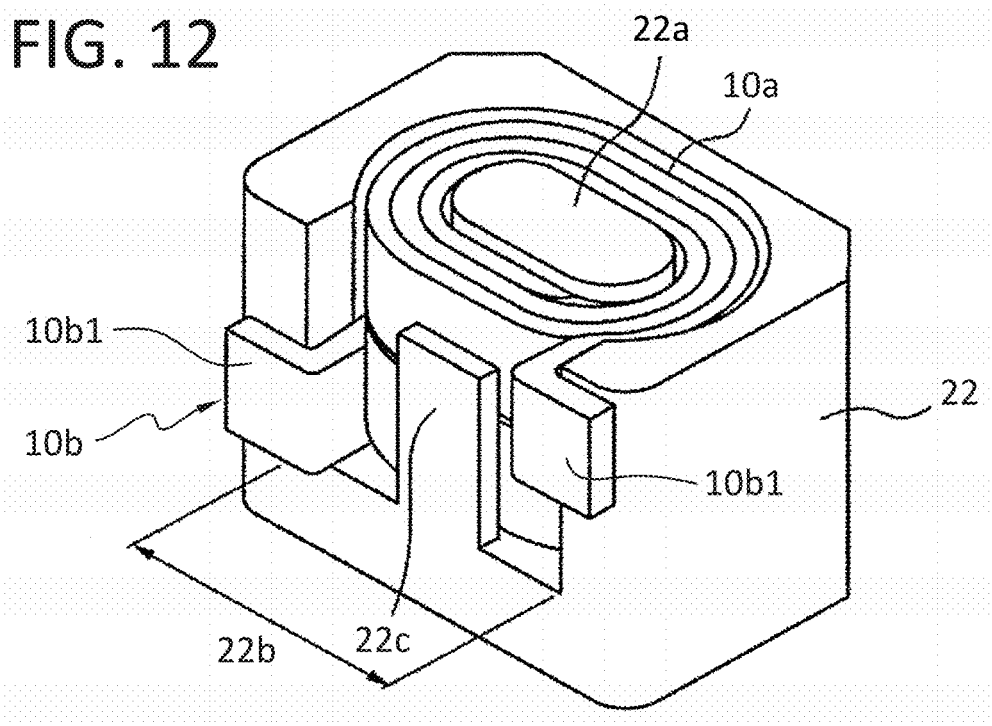
FIG. 12 is a perspective view illustrating an overview of a variation on a first reserve molded body.

Embodiment 5 and Embodiment 6 use a second reserve molded body having a different shape from that used in the method of manufacturing according to Embodiment 1. However, the shape of the second reserve molded body is not limited thereto, and for example, a second reserve molded body 36, illustrated in FIG. 10, a second reserve molded body 38, illustrated in FIG. 11, or the like may be used. The second reserve molded body 36 illustrated in FIG. 10 includes a plate-shaped part 36*a*, and protruding parts 36*b* protruding from respective opposing side surface parts of the plate-shaped part 36*a*. The second reserve molded body 36 may be disposed within the metal mold so that the plate-shaped part 36*a* opposes the surface of the first reserve molded body on the side opposite from the bottom part, or within the metal mold so that the protruding parts 36*b* oppose the surface of the first reserve molded body on the side opposite from the bottom part. The second reserve molded body 38 illustrated in FIG. 11 includes a plate-shaped part 38*a*, and a protruding part 38*b* protruding from one surface of the plate-shaped part 38*a*. The second reserve molded body 38 may be disposed within the metal mold so that the plate-shaped part 38*a* opposes the surface of the first reserve molded body on the side opposite from the bottom part, or within the metal mold so that the protruding part 38*b* oppose the surface of the first reserve molded body on the side opposite from the bottom part. By forming the first reserve molded body, in which the coil is disposed, and the second reserve molded body as a single entity within the metal mold, a molded body containing the wound part of the coil, and in which the surfaces of the end portions 10*b*1 of the extended parts 10*b* of the coil are exposed, is formed.

Embodiment 7

A method of manufacturing a surface-mounted inductor according to Embodiment 7 is the same as the method of manufacturing according to Embodiment 1, aside from that a composite material containing unformed magnetic powder is disposed on the first reserve molded body instead of the second reserve molded body, and the molded body is obtained by molding the first reserve molded body and the composite material as a single entity within the metal mold.

In the method of manufacturing according to Embodiment 7, the first reserve molded body in which the coil being disposed is arranged within the metal mold, and the composite material containing a magnetic powder is disposed within the metal mold so as to cover the exposed upper surface of the wound part of the coil within the first reserve molded body. At this time, the cutout part from which the side surface of the wound part of the coil is exposed may or may not be filled with the composite material. The composite material and the first reserve molded body are molded into an integrated entity by pressure-molding in the winding axis direction of the wound part of the coil with the composite material disposed thereon, and a molded body containing the wound part of the coil is formed, with the surfaces of the end portions 10*b*1 of the extended parts 10*b* of the coil being exposed. In an area of the molded body corresponding to the cutout part of the first reserve molded body, the density of the magnetic powder in an area interposed between the extended parts is lower than the density of the magnetic powder in other areas due to differences in the fluidity of the composite material.

With the method of manufacturing according to Embodiment 7, a process of preparing a separate second reserve molded body can be omitted, which makes it possible to reduce the number of processes in the method of manufacturing as a whole.

Embodiment 8

A method of manufacturing a surface-mounted inductor according to Embodiment 8 is the same as the method of manufacturing according to Embodiment 1, aside from using a first reserve molded body 22, which corresponds to the first reserve molded body according to the Embodiment 1 being formed so that a protruding part 22*c*, which protrudes along an outer circumferential part in a central area of a cutout part 22*b* in the wall part, is formed to be narrower than the cutout part 22*b* and lower than the cutout part 22*b*. The first reserve molded body 22 is formed from a composite material containing a magnetic powder, and has a bottom part, a winding shaft part 22*a* arranged on the bottom part, and a wall part arranged so as to surround the bottom part. The cutout part 22*b* is provided in part of one of four side surfaces surrounding the bottom part of the wall part, and the protruding part 22*c* is provided in the cutout part 22*b*, in a part of the outer circumference of the bottom part. With such a form, the shape of the first reserve molded body 22 becomes complicated, meaning it can be difficult to form the molded body smaller than the "25-20-20" size, which corresponds to a longitudinal direction length L of approximately 2.5 mm, a lateral direction length W of approximately 2.0 mm, and a height T of approximately 2.0 mm. As such, the first reserve molded body having this shape is suitable for forming a molded body exceeding the "25-20-20" size, which corresponds to a longitudinal direction length L of approximately 2.5 mm, a lateral direction length W of approximately 2.0 mm, and a height T of approximately 2.0 mm. Even when forming the molded body in this manner, the protruding part 22*c* is formed so as to be smaller than the cutout part 22*b* in the wall part, and thus the area of the molded body corresponding to the cutout part 22*b* has a lower magnetic powder density than the other areas formed directly from the first reserve molded body or the second reserve molded body.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A surface-mounted inductor comprising:

a coil including a wound part formed by winding a conductive wire, and extended parts extended from an outer circumference of the wound part;

a molded body, constituted by a composite material containing a magnetic powder, that contains the coil; and outer terminals that are connected to corresponding end portions of the extended parts and are disposed on a mounting surface, wherein the wound part of the coil is contained within the molded body so that a winding axis of the wound part is parallel to the mounting surface;

the extended parts of the coil are extended toward the mounting surface;

the end portions of the extended parts are disposed so that surfaces thereof are exposed from a mounting surface-side surface of the molded body; and in the molded body, a density of the magnetic powder between the end portions of the extended parts on the mounting surface-side surface is lower than a density of the magnetic powder in the surface on the opposite side from the mounting surface.

2. The surface-mounted inductor according to claim 1, wherein the extended parts of the coil are disposed so as not to intersect each other toward the mounting surface-side surface.

3. The surface-mounted inductor according to claim 1, wherein the magnetic powder is a metallic magnetic powder.

4. The surface-mounted inductor according to claim 2, wherein the magnetic powder is a metallic magnetic powder.

* * * * *